US008138861B2

(12) United States Patent
Krieger et al.

(10) Patent No.: US 8,138,861 B2
(45) Date of Patent: Mar. 20, 2012

(54) INERTIAL CATCH FOR AN AUTOMATIC TRANSFER SWITCH POWER CONTRACTOR

(75) Inventors: James William Krieger, Pittsburgh, PA (US); Paul Alan Merck, Crescent, PA (US); Robert Michael Slepian, Murrysville, PA (US); Amelia Marie Stay, Monaca, PA (US)

(73) Assignee: Eaton Corporation, Cleveland, OH (US)

( * ) Notice: Subject to any disclaimer, the term of this patent is extended or adjusted under 35 U.S.C. 154(b) by 459 days.

(21) Appl. No.: 12/466,780

(22) Filed: May 15, 2009

(65) Prior Publication Data

US 2010/0288610 A1 Nov. 18, 2010

(51) Int. Cl.
*H01H 9/20* (2006.01)

(52) U.S. Cl. ..... 335/168

(58) Field of Classification Search ..... 335/167–176, 335/2, 68–77, 159, 161, 16; 200/50.32–50.35
See application file for complete search history.

(56) References Cited

U.S. PATENT DOCUMENTS 4,423,336 A * 12/1983 Iverson et al. ..... 307/64
4,804,933 A * 2/1989 Becker et al. ..... 335/186
7,898,372 B2 * 3/2011 Melchionne, Jr. ..... 335/190

* cited by examiner

*Primary Examiner* — Bernard Rojas
(74) *Attorney, Agent, or Firm* — Martin J. Moran

(57) ABSTRACT

A catch assembly coupled to the operating mechanism of the ATS is provided. The catch assembly is structured to arrest movement within the operating mechanism when the operating mechanism moves at more than the speed for which it was designed. That is, the catch assembly does not engage when the operating mechanism is stationary, or moving at a standard speed, i.e. the speed at which the operating mechanism was intended to move. When there is a strong over-current, such as during a withstand test, a magnetic field causes a movable contact to separate from a fixed contact assembly which, in turn, causes the operating mechanism to move at a speed that is faster than the standard speed. The catch assembly is structured to engage and arrest the motion of the operating mechanism when the operating mechanism moves at a speed that is faster than the standard speed.

20 Claims, 5 Drawing Sheets

INERTIAL CATCH FOR AN AUTOMATIC TRANSFER SWITCH POWER CONTRACTOR

BACKGROUND OF THE INVENTION

1. Field of the Invention

This invention relates to a bypass isolation open or closed transition automatic transfer switch assembly, commonly called an automatic transfer switch assembly (ATS assembly) and, more specifically, an ATS assembly having a latch assembly structured to resist, and preferably prevent, actuating the switch during a high fault current.

2. Background Information

Certain installations, e.g. hospitals, (hereinafter "the system load") must have power systems structured to provide an uninterruptable power supply. The primary power source is typically the public power grid and the secondary power source is typically a generator. Both of these sources are structured to provide power over an extended period of time. That is, the system typically draws power from the primary power source, however, if that source becomes disabled for any period of time, the secondary source is used. Generally, it is not desirable to have two power sources providing electricity at the same time. That is, the currents from the sources are typically in different phases and cannot be combined safely.

The ATS is not a circuit breaker or similar device structured to interrupt the current in the event of an over-current condition. Circuit breakers, and similar devices, structured to protect the system load from over-current conditions are typically located upstream and/or downstream of the ATS.

The ATS includes a housing, an operating mechanism, a first line bus, a second line bus, a load bus, a first line movable contact, a second line movable contact, a fixed contact assembly, and a control device. The operating mechanism, first line movable contact, second line movable contact, fixed contact assembly, and control device are disposed within the housing. The first line bus is substantially disposed within the housing but includes a terminal that extends outside the housing. The first line bus terminal is coupled to, and in electrical communication with, the primary power source. Similarly, the second line bus is substantially disposed within the housing but includes a terminal that extends outside the housing. The second line bus terminal is coupled to, and in electrical communication with, the secondary power source. The load bus also is disposed, substantially, within the housing and includes a terminal that extends outside the housing. The load bus terminal is coupled to, and in electrical communication with, the system load. The fixed contact assembly is coupled to, and in electrical communication with, the load bus. The fixed contact assembly is structured to be engaged, alternately, by the first line movable contact and the second line movable contact.

The first line movable contact is coupled to, and in electrical communication with, the first line bus. The first line movable contact is structured to move between a first position, wherein the first line movable contact does not engage the fixed contact assembly, and a second position, wherein the first line movable contact engages, and is in electrical communication with, the fixed contact assembly. Similarly, The second line movable contact is coupled to, and in electrical communication with, the second line bus. The second line movable contact is structured to move between a first position, wherein the first line movable contact does not engage the fixed contact assembly, and a second position, wherein the second line movable contact engages, and is in electrical communication with, the fixed contact assembly. Only one of the first and second movable contacts engages the fixed contact assembly at a time. That is, in the normal operating configuration, the first contact assembly is in the second position, thereby providing electricity to the system load from the primary power source, and the second contact assembly is in the first position. If the need arises, the first contact assembly is moved into the first position while the second contact assembly moves into the second position. The transfer occurs almost instantaneously. In this configuration, the secondary power source provides electricity to the system load.

Operation, i.e. positioning of, the first and second contact assemblies is performed by the operating mechanism. The operating mechanism includes a plurality of mechanical linkages that are configured to ensure that both the first and second contact assemblies are not in the second position at the same time. Both the first and second contact assemblies may be in the first position at the same time, i.e. the system load would not be receiving power from the ATS. The operating mechanism includes one or more springs structured to maintain the engaged contact assembly in the second configuration.

The control device actuates the operating mechanism. The control device, typically a solenoid, is structured to receive a control signal from a remote, or local, location. Thus, when the control device receives the control signal, the operating mechanism is actuated and the first and second contact assemblies move into a different position.

An ATS must be tested to ensure the ATS meets a defined operating criteria. As part of the testing procedures, the ATS is subjected to a "withstand" current. This is, essentially, an intense and sudden over-current. When such a current passes through the fixed contact assembly a strong magnetic field is created. This magnetic field may be strong enough to overcome the bias of the operating mechanism springs maintaining the engaged contact assembly in the second position. That is, the magnetic field causes the closed contact to separate from the fixed contact. If the over-current is sufficiently strong, the closed contact is rapidly moved into the first position. This, in turn, causes the operating mechanism to be actuated and move the other contact assembly into the second position. That is, the withstand current may cause the ATS to switch from one power source to the other. If this occurs, the ATS has failed the test.

SUMMARY OF THE INVENTION

The concept recited in the claims provides for a catch assembly that is coupled to the operating mechanism of the ATS. The catch assembly is structured to arrest movement within the operating mechanism when the operating mechanism moves at more than the speed for which it was designed. That is, the catch assembly does not engage when the operating mechanism is stationary, or moving at a "standard" speed, i.e. the speed at which the operating mechanism was intended to move. When there is a strong over-current, such as during a withstand test, the magnetic field, discussed above, causes the operating mechanism to move at a speed that is faster than the standard speed. The catch assembly is structured to engage and arrest the motion of the operating mechanism in this condition.

BRIEF DESCRIPTION OF THE DRAWINGS

A full understanding of the invention can be gained from the following description of the preferred embodiments when read in conjunction with the accompanying drawings in which.

DESCRIPTION OF THE PREFERRED EMBODIMENTS

Figure 1:
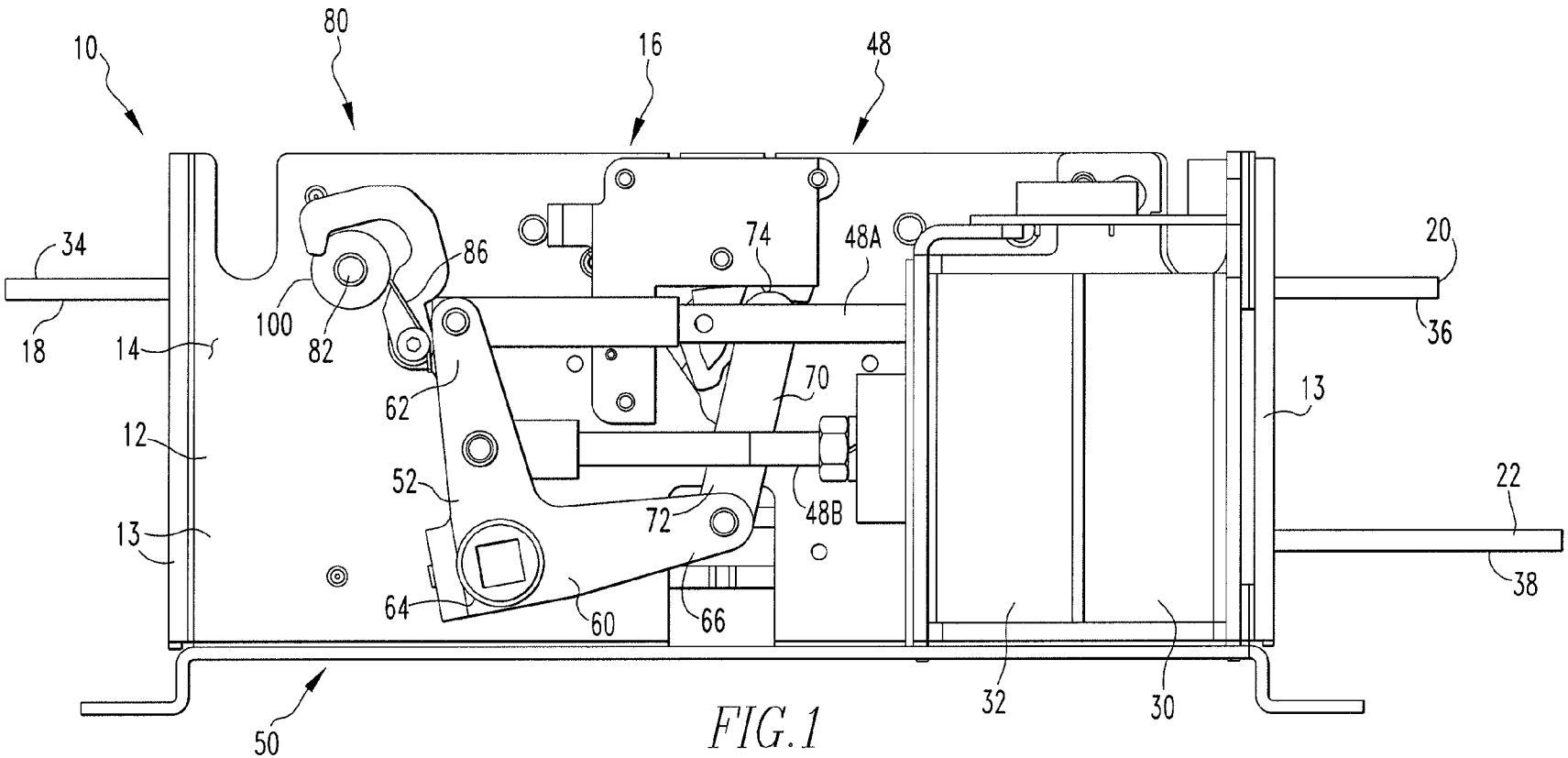
FIG. 1 is a cross-sectional side view of a portion of an ATS with the operating mechanism in a first position.

As used herein, "coupled" means a link between two or more elements, whether direct or indirect, so long as a link occurs.

As used herein, "directly coupled" means that two elements are directly in contact with each other.

As used herein, "fixedly coupled" or "fixed" means that two components are coupled so as to move as one while maintaining a constant orientation relative to each other.

As used herein and with reference to electrical components, "engage" shall mean temporarily coupled and allowing for electrical communication.

As used herein, a "vertex" is the area where two, or more, generally straight components or elements meet or are coupled.

As is known, any component structured to carry an electrical current is made from a conductive material such as, but not limited to, copper. Components that are not intended to carry a current are made from non-conductive materials and/or are separated from those elements carrying a current by a non-conductive material.

A note on "positions" of the various elements. Generally, the automatic transfer switch is in a configuration wherein power from a primary power source passes through the automatic transfer switch. Accordingly, most "first" positions correspond to this operating configuration. When the automatic transfer switch is in a configuration wherein power from a secondary power source passes through the automatic transfer switch, most components are in a "second" positions. The exception to this convention is the position of the first and second movable contacts. To have the description of the positions of the first and second movable contacts consistent with each other, the first and second movable contacts are in the "first position" when the circuit is open, i.e. the contact is not engaging the fixed contact assembly. Similarly, when either the first and second movable contacts are in the "second position," the contact engages the fixed contact assembly. Thus, in a normal operating configuration, most components are in the "first position," however, the first movable contact is in the "second position," i.e. closed with power flowing therethrough.

As shown in FIG. 1-4, an automatic transfer switch (ATS) 10 includes a housing 12 (shown in part) that defines an enclosed space 14, an operating mechanism 16, a first line bus 18, a second line bus 20, a load bus 22, a first line movable contact 24 (hereinafter "first movable contact"), a second line movable contact 26 (hereinafter a "second movable contact"), a fixed contact assembly 28, and a control device 30 having a actuator 32. The operating mechanism 16, first movable contact 24, second movable contact 26, fixed contact assembly 28, and control device 30 are disposed within the housing enclosed space 14. The first line bus 18 is substantially disposed within the housing enclosed space 14 but includes a terminal 34 that extends outside the housing 12. The first line bus terminal 34 is coupled to, and in electrical communication with, the primary power source (not shown). Similarly, the second line bus 20 is substantially disposed within the housing enclosed space 14 but includes a terminal 36 that extends outside the housing 12. The second line bus terminal 36 is coupled to, and in electrical communication with, the secondary power source (not shown). The load bus 22 also is disposed, substantially, within the housing enclosed space 14 and includes a terminal 38 that extends outside the housing 12. The load bus terminal 38 is coupled to, and in electrical communication with, the system load (not shown). The fixed contact assembly 28 is coupled to, and in electrical communication with, the load bus 22. The fixed contact assembly 28 is structured to be engaged, alternately, by the first movable contact 24 and the second movable contact 26.

Figure 2:
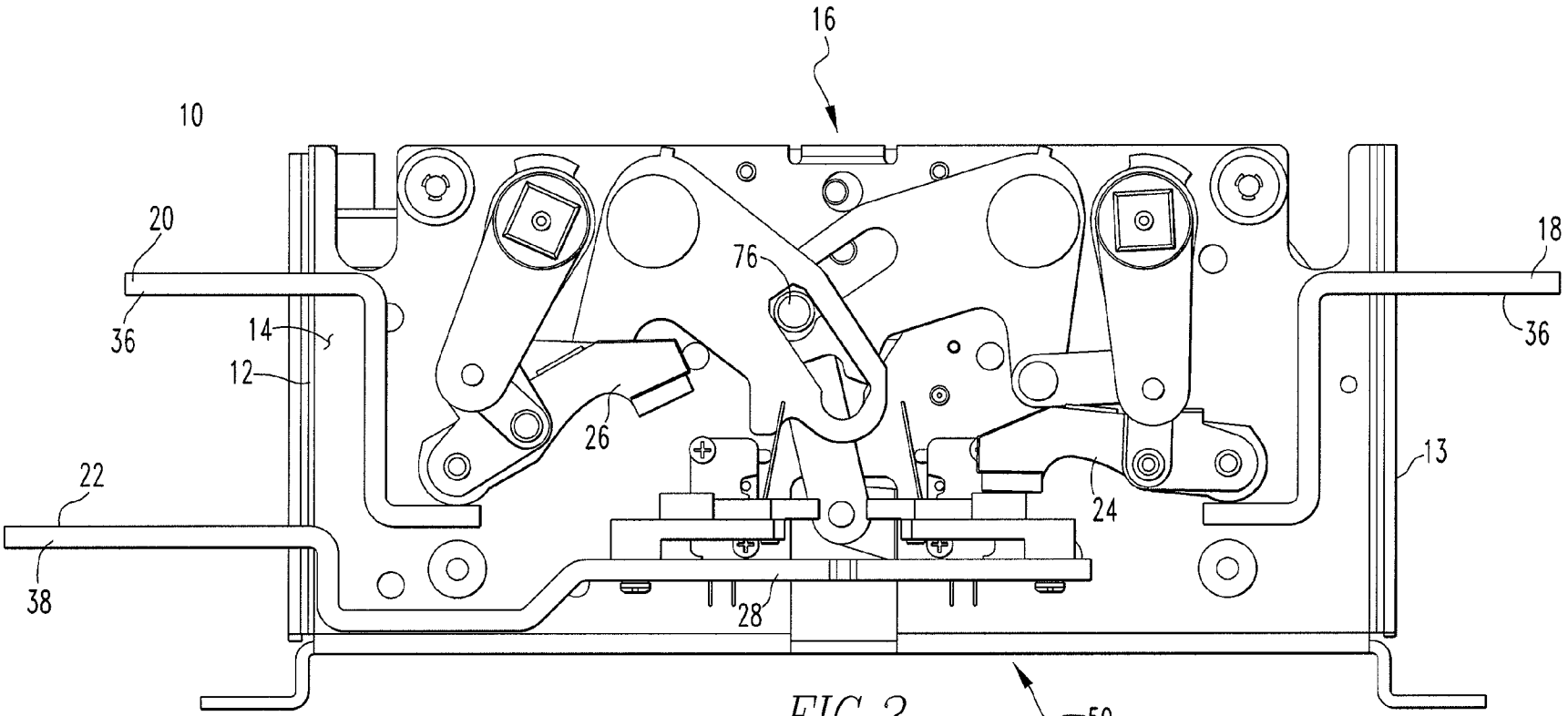
FIG. 2 is a cross-sectional side view of another portion of an ATS with the operating mechanism in a first position, a first movable contact in a second position, and a second movable contact in a first position.
Figure 4:
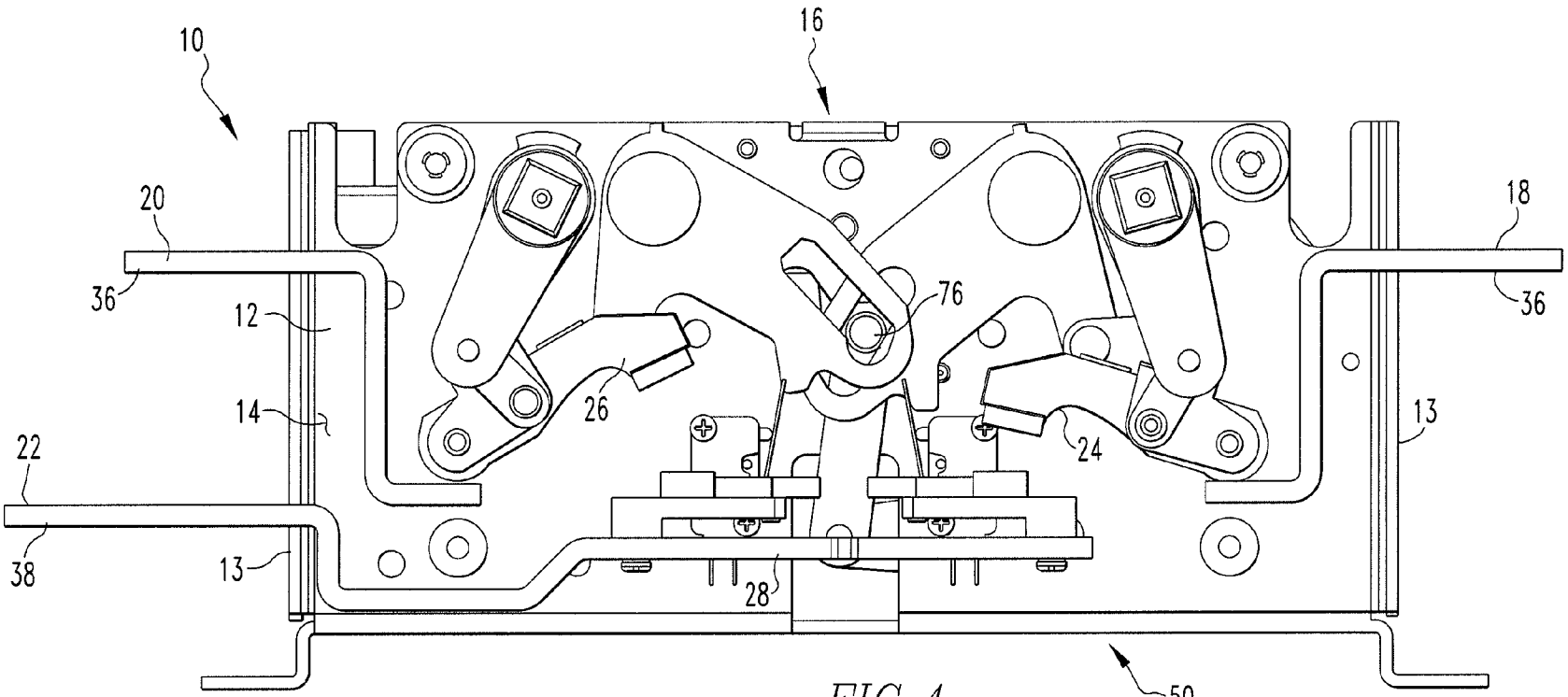
FIG. 4 is a cross-sectional side view of another portion of an ATS with the operating mechanism shown in the configuration during a withstand test, a first movable contact in a position separated from a fixed contact assembly, and a second movable contact in a first position.

The first movable contact 24 is coupled to, and in electrical communication with, the first line bus 18. The coupling between the first movable contact 24 and the first line bus 18 may be through a conductor, such as, but not limited to a copper wire (not shown), but is preferably a direct, but movable, coupling as shown in FIGS. 2 and 4. The first movable contact 24 is structured to move between a first position, wherein the first movable contact 24 does not engage the fixed contact assembly 28, and a second position, wherein the first movable contact 24 engages, and is in electrical communication with, the fixed contact assembly 28. Similarly, the second movable contact 26 is coupled to, and in electrical communication with, the second line bus 20. The second movable contact 26 is structured to move between a first position, wherein the second movable contact 26 does not engage the fixed contact assembly 28, and a second position, wherein the second movable contact 26 engages, and is in electrical communication with, the fixed contact assembly 28.

Only one of the first and second movable contacts 24, 26 engages the fixed contact assembly 28 at a time. That is, in the normal operating configuration, the first movable contact 24 is in the second position, thereby providing electricity to the system load from the primary power source, and the second movable contact is in the first position. As the ATS 10 typically operates in this configuration, the operating mechanism 16 in this configuration may also be identified as a "stationary condition." If the need arises, the first movable contact 24 is moved into the first position while the second movable contact 26 moves into the second position. In this configuration, the secondary power source provides electricity to the system load.

The configuration/position of the operating mechanism 16 is controlled by the control device actuator 32. The control device actuator 32, which typically includes a solenoid (not shown) is structured to receive a command signal from a user. Upon receiving a command signal, the control device actuator is actuated and, via at least one actuator link 48 (described below), causes the operating mechanism 16 to separate the engaged movable contact 24, 26 from the fixed contact assembly 28 and engage the other movable contact 24, 26. Because the operating mechanism 16 is designed and intended to operate at the speed caused by actuation of the at least one actuator link 48, this motion is identified as the "standard motion condition."

Operation, i.e. positioning of, the first and second contacts 24, 26 is performed by the operating mechanism 16. That is, the operating mechanism 16 is structured to move the first movable contact 24 and the second movable contact 26 between their respective first and second positions. The operating mechanism 16 may be described, generally, as being in a first position, or configuration, when the first movable contact 24 is in the second (closed) position while the second movable contact 26 is in the first (open) position, and, the operating mechanism 16 is in a second position, or configuration, when the first movable contact 24 is in the first (open) position while the second movable contact 26 is in the second (closed) first position. The operating mechanism 16 includes a plurality of mechanical linkages 50 that are configured to ensure that both the first and second contacts 24, 26 are not in the second position at the same time. Both the first and second contacts 24, 26 may be in the first position at the same time, i.e. the system load would not be receiving power through the ATS. The operating mechanism 16 includes one or more springs (not shown) structured to maintain the engaged contact 24, 26 in the second configuration. Generally, the linkages 50 not detailed below operate as shown in FIGS. 2 and 4.

With regard to the various linkages, the links and associated components may, and often are, disposed in spaced laminations. The laminations may include substantially identical and aligned components. Thus, when viewed from the side, as in FIGS. 1-4, only a single element may be seen. Further, the identical and aligned components may be used to "sandwich" a portion of another, singular component. Such configurations, however, may typically be reversed without affecting the mechanical operation of the device. For example, a configuration may have two first elements sandwiching a portion of a single second element, and, for this example, pivotally couple thereto. The same mechanical operation could be achieved if the same shaped elements were configured with a single first element being sandwiched between two second elements. As a more specific example, as detailed below, there is an L-link 52 pivotally coupled to the at least one actuator link 48. In the preferred embodiment, there are two L-links 52 disposed on either side of the at least one actuator link 48. The configuration could, however, be reversed with two actuator links 48 being disposed on either side of a single L-link 52. In either configuration, the mechanical operation of the linkage is substantially identical. Accordingly, in the following discussion, a single link element will be described at a location and performing a specified function. It is, however, understood that each single "link" may include a plurality of substantially identical, spaced and aligned components that move as a single element.

Figure 3:
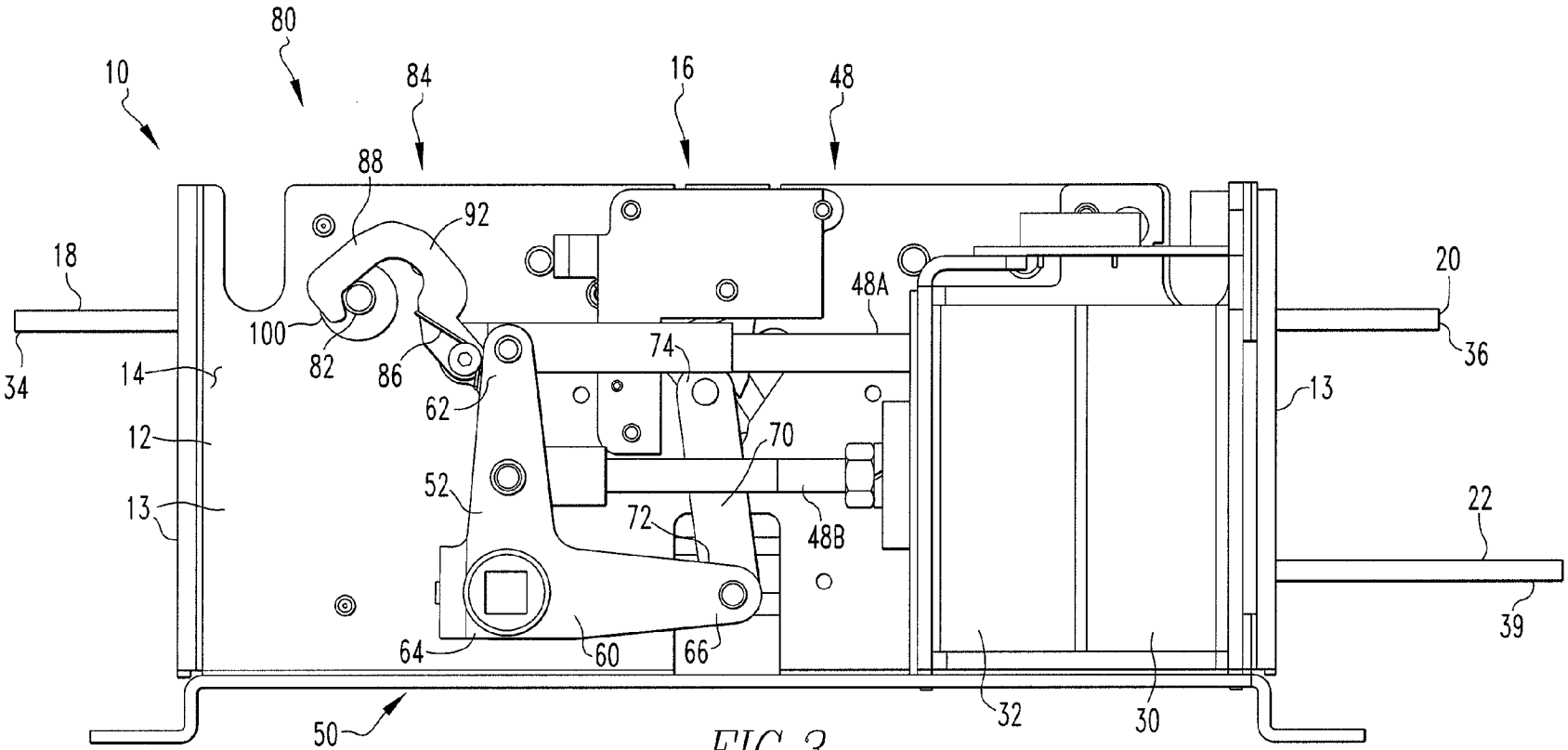
FIG. 3 is a cross-sectional side view of a portion of an ATS with the operating mechanism shown in the configuration during a withstand test.

The operating mechanism linkages 50 relevant to the claims recited below are shown in FIGS. 1 and 3. The linkages include an L-link 52, a primary link 54, as well as the at least one actuator link 48. The L-link 52 having a body 60 that includes a first end 62, a vertex 64, and a second end 66. The L-link first end 62, vertex 64 and second end 66 generally define a plane. The L-link 52 is rotatably coupled to the housing 12, preferably at the vertex 64. The primary link 54 includes an elongated body 70 having a first end 72 and a second end 74. The primary link first end 72 is movably, preferably pivotally/rotatably, coupled to the L-link second end 66. The primary link second end 74 is coupled to a cam bushing 76 that extends generally parallel to the axis of rotation of the primary link first end 72. The cam bushing 76 engages other linkages 50 in the operating mechanism 16 that control the position of the first and second movable contacts 24, 26 as shown in FIGS. 2 and 4.

The control device 30 includes the control device actuator 32 and the at least one actuator link 48. As shown, the control device 30 has two actuator links 48A, 48B. The actuator 32 is structured to move the control device actuator links 48A, 48B between a first, extended position and a second, retracted position. The control device actuator links 48A, 48B are movably, preferably pivotally/rotatably, coupled to the L-link first end 62 and/or a medial portion of the L-link body 60 between the L-link first end 62 and vertex 64.

In this configuration, the L-link 52 is structured to move between two positions, a first position and a second position in response to the control device actuator links 48A, 48B moving between their first, extended position and second, retracted position. As the L-link 52 moves between the first position and the second position, the primary link 54, and therefore the cam bushing 76 the remaining linkages 50, or generally the operating mechanism 16, move between the first and second positions. As described above, when the operating mechanism 16 is in a first position, or configuration, the first movable contact 24 is in the second (closed) position while the second movable contact 26 is in the first (open) position, and, when the operating mechanism 16 is in the second position, or configuration, the first movable contact 24 is in the first (open) position while the second movable contact 26 is in the second (closed) first position.

As noted above, during normal operation, the operating mechanism 16 is not moving between positions and is in a stationary condition. Further, when the control device actuator 32 is actuated, the operating mechanism 16 rapidly, and almost instantaneously, moves from one position to the other. The speed at which the operating mechanism 16 moves, while very fast, is intended and has been identified as the standard motion condition. When there is an over-current condition, e.g. during a "withstand test," the electromagnetic field at the movable contacts 24, 26 causes the engaged movable contact to move away from the fixed contact assembly 28. This motion is communicated to the operating mechanism 16 via the linkages 50 primarily shown in FIGS. 2 and 4. This motion is more rapid than the standard motion condition and is identified as the "withstand motion condition." It is also noted that there may be a fourth condition, wherein a slight over-current condition has caused the engaged movable contact 24, 26 to move off the fixed contact assembly 28 at a speed slower than the withstand motion condition. As this condition is not sufficient to cause the engaged movable contact to move away from the fixed contact assembly 28 at a speed sufficient to further cause the operating mechanism to switch position, this fourth condition is hereinafter assumed to be a sub-condition of the stationary condition.

To resist, and preferably to prevent, the movable contacts 24, 26, as well as the operating mechanism 16, from switching positions upon exposure to an over-current/withstand current condition, the ATS 10 includes a catch assembly 80. The catch assembly 80 is structured to resist, and preferably to prevent, the operating mechanism 16 from moving from one position to the other when the operating mechanism 16 is in the withstand motion condition, while allowing the operating mechanism 16 to move from one position to the other when the operating mechanism 16 is in the standard motion condition.

This is accomplished by utilizing the momentum of a catch member 88 to selectively overcome the bias of a catch assembly spring 86. The catch member 88 is coupled to the operating mechanism 16 and the speed of the operating mechanism 16 is imparted to the catch member 88. As the mass of the catch member 88 is substantially constant, changing with oxidation or addition of dust, etc., the momentum (mass× speed) of the catch member 88 varies depending upon the speed of the operating mechanism 16. By varying the mass, and/or distribution of weight, of the catch member 88 and the strength of the catch assembly spring 86, the catch assembly

80 may be structured so that, when the operating mechanism 16 is in one of the stationary condition or the standard motion condition, the bias applied by the catch assembly spring 86 to the catch member 88 maintains the catch member 88 in a first, unlatched position. Conversely, when the operating mechanism 16 is in the withstand motion condition, the bias applied by the catch assembly spring 86 to the catch member 88 is insufficient to maintain the catch member 88 in the first, unlatched position thereby allowing the catch member 88 to move into a second, latched position. When said catch member is in the second, latched position, the motion of the operating mechanism 16 is arrested.

It is noted that for the operating mechanism 16 to be in the withstand motion condition, the engaged movable contact 24, 26 will have moved off the fixed contact assembly 28. This is, expected and allowable. Again, an ATS is not a circuit breaker and does not perform that function. During the time the engaged movable contact 24, 26 is spaced from the fixed contact assembly 28, an arc will likely form between the engaged movable contact 24, 26 and the fixed contact assembly 28. This arc will maintain the current through the ATS 10. Further, depending upon the duration of the withstand motion condition, the operating mechanism 16 will either reconnect the engaged movable contact 24, 26 to the fixed contact assembly 28, or, an upstream/downstream circuit breaker (not shown) will interrupt the current.

The catch assembly 80 includes a catch stop 82, a catch member assembly 84 and at least one spring 86 having a bias. The catch member assembly 84 includes a catch member 88 and a pivot member 90. The catch member 88 may be any shape structured to engage the catch stop 82, however, in the preferred embodiment, the catch member 88 has a hook-shaped body 92. As shown, the catch member hook-shaped body 92 approximates the shape of a question mark, i.e. "?." The catch member 88 is movably coupled to at least one operating mechanism link 50, preferably at the L-link first end 62. The pivot member 90 may be coupled to the L-link first end 62 and, preferably, extends in a direction generally parallel to the axis of rotation of the L-link body 60. The catch member 88 is rotatably coupled to the pivot member 90. The catch member 88 is structured to move between a first position, wherein the catch member 88 does not engage the catch stop 82, and a second position, wherein the catch member 88 engages the catch stop 82.

Figure 5:
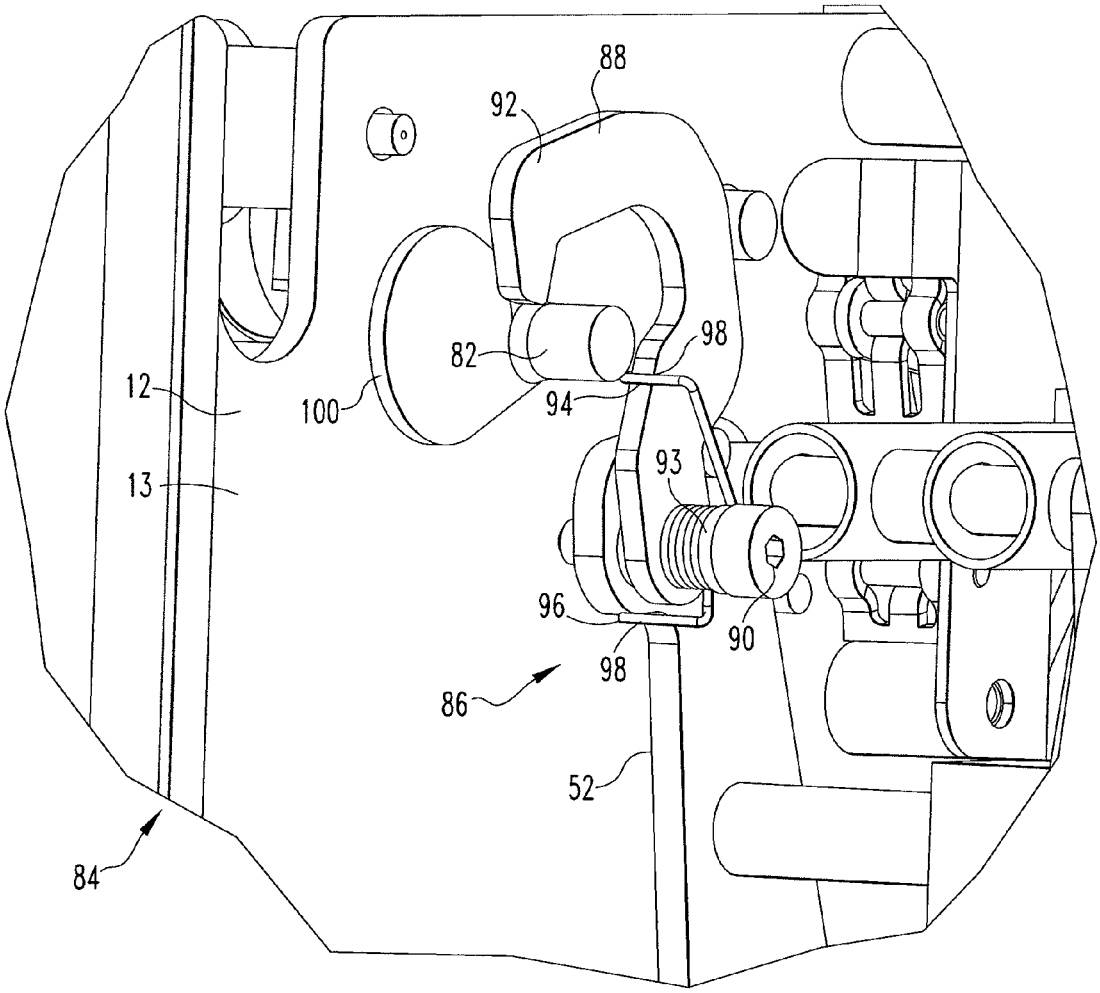
FIG. 5 is a detailed isometric view of a catch assembly.

The at least one spring 86 is, preferably, a torsion spring. If the at least one spring 86 is a torsion spring, the at least one spring 86 includes a coiled body 92, a first end 94 and a second end 92. The two spring ends 94, 96 may be elongated so as to provide engagement surfaces 98. The spring engagement surfaces 98, i.e. the spring ends 94, 96, may be bent or otherwise shaped so as to be structured to engage at least the catch member 88, and provide a bias thereto, and another surface not on the catch member 88. As shown in FIG. 5, the second spring end 96 engages the L-link 52, but may also engage other linkages 50 or the housing 12.

The catch stop 82 may be of any shape that corresponds, i.e. is structured to be engaged by, the catch member 88. As shown, the catch stop 82 is a post 100. The catch stop 82 may be mounted on any surface that is disposed at the proper location, e.g. on an operating mechanism linkage 50 (not shown) but is preferably coupled to the housing 12. That is, the housing 12 includes a plurality of generally planar walls 13 and the catch stop 82 is a post 100 coupled directly to and extending generally perpendicular from a housing wall 13.

In operation, the mass and/or weight and balance of the catch member 88 is structured to have a momentum that is slightly more than the bias of the at least one spring 86 at the withstand motion condition. It is noted that there are virtually infinite variations of mass and shape (which affects the weight and balance) of the catch member 88 and the strength, or bias, of the at least one spring 86 which will accomplish the goal of the catch assembly 80. To effect this goal, all that is required is that the momentum of the catch member 88 be able to overcome the bias of the at least one spring 86 when the operating mechanism 16 moves in the withstand motion condition, but is not able to overcome the bias of the at least one spring 86 when the operating mechanism 16 moves in the standard motion condition. It is further noted that the bias of the at least one spring 86 is structured to return the catch member 88 to the first position when the operating mechanism 16 is in the stationary condition.

The catch assembly 80 operates as follows during an exemplary withstand test. While in the stationary condition, the bias of the at least one spring 86 maintains the catch member 88 in the first position. When the withstand current is applied, the electromagnetic forces at the interface of the engaged contact 24, 26 and the fixed contact assembly 28 cause the engaged contact 24, 26 and the fixed contact assembly 28 to separate at a speed that is greater than the normal operating speed of the operating mechanism 16, i.e. the operating mechanism is in the withstand condition. As the motion is imparted to the catch member 88, the momentum created in the catch member 88 overcomes the bias of the at least one spring 86 and the catch member 88 moves into the second position. That is, the catch member 88 latches of the catch stop 82. As the catch member 88 is coupled to the operating mechanism 16, the motion of the operating mechanism 16 is arrested prior to the time the operating mechanism 16 switches position. As the withstand current abates, the operating mechanism 16 returns the movable contacts 24, 26 to the pre-test positions. That is, the operating mechanism 16 returns to the stationary condition and the at least one spring 86 returns the catch member 88 to the first position.

Conversely, during a planned switch from one power source to the other, the catch assembly 80 operates as follows. A user actuates the control device actuator 32 causing the L-link 52 to move from one position to another. This motion causes the operating mechanism 16 to move from one position to the other position. The operating mechanism 16 moves at a speed that is slower than the speed during a withstand test, i.e. in the standard motion condition. While in the standard motion condition, the operating mechanism 16 moves and imparts motion to the catch member 88. The speed of the operating mechanism 16 during the standard motion condition, however, does not create sufficient momentum in the catch member 88 to overcome the bias of the at least one spring 86. Thus, the catch member 88 does not move into the second position and the motion of the operating mechanism 16 is not arrested. It is noted that, during a transition in the standard motion condition, the at least one spring 86 may flex and the catch member 88 may move. Thus, at the end of the standard motion condition, the operating mechanism 16 returns to the stationary condition and the at least one spring 86 returns the catch member 88 to the first position.

It is noted that the operational characteristics of the catch assembly 80, i.e. the speed at which the operating mechanism 16 must move in order to move the catch member 88 into the second position, may be adjusted by changing the mass of the catch member 88. This may be accomplished by coupling a slug (not shown), or similar element, having mass to the catch member 88. By increasing the mass of the catch member 88, the catch member 88 will move into the second position at a slower speed; that is, the speed of the withstand condition is reduced. Alternately, the speed of the withstand condition may be changed by altering the weight and balance of the catch member 88. For example, the catch member 88 may include a threaded rod (not shown) extending at least somewhat radially relative to the axis of the catch member's 88 rotation. That is, the rod cannot extend circumferentially about, or tangent to, the axis of the catch member's 88 rotation. A nut (not shown) may be movably disposed on the threaded rod. As the nut is moved radially, the weight and balance of the catch member 88 changes and the corresponding speed of the withstand condition changes as well. Similarly, by replacing the spring with a spring having different characteristics, the speed that defines the withstand condition changes as well.

While specific embodiments of the invention have been described in detail, it will be appreciated by those skilled in the art that various modifications and alternatives to those details could be developed in light of the overall teachings of the disclosure. Accordingly, the particular arrangements disclosed are meant to be illustrative only and not limiting as to the scope of invention which is to be given the full breadth of the claims appended and any and all equivalents thereof.

What is claimed is:

1. A catch assembly for an automatic transfer switch, said automatic transfer switch including a housing assembly defining a substantially enclosed space, a first movable contact, a second movable contact, a fixed contact assembly, and an operating mechanism, said operating mechanism having at least one link and structured to move said first line movable contact and said second line movable contact, said first line movable contact structured to move between a first position, wherein said first line movable contact does not engage said fixed contact assembly, and a second position, wherein said first line movable contact engages, and is in electrical communication with, said fixed contact assembly, said second line movable contact structured to move between a first position, wherein said second line movable contact does not engage said fixed contact assembly, and a second position, wherein said second line movable contact engages, and is in electrical communication with, said fixed contact assembly, said operating mechanism further structured to allow only one of said first or second movable contacts to be in said second position at one time, said operating mechanism further structured to be in one of at least three conditions, a stationary condition, a standard motion condition, or a withstand motion condition, wherein when said operating mechanism is in said stationary condition said operating mechanism and said first and second movable contacts are not moving, wherein when said operating mechanism is in said standard motion condition said operating mechanism is moving said first and second movable contacts to the other position at a standard speed, and wherein when said operating mechanism is in said withstand motion condition said operating mechanism is moving said first and second movable contacts to the other position at a speed faster than said standard speed, and wherein said catch assembly comprises:

a catch stop;

a catch member assembly including a catch member;

at least one spring having a bias;

said catch member movably coupled to at least one said operating mechanism link, said catch member structured to move between a first position, wherein said catch member does not engage said catch stop, and a second position, wherein said catch member engages said catch stop;

said at least one spring structured to engage said catch member and provide a bias thereto;

wherein, when said operating mechanism is in one of said stationary condition or said standard motion condition, said bias applied by said spring to said catch member maintains said catch member in said first position;

wherein, when said operating mechanism is in said withstand motion condition, said bias applied by said spring to said catch member is insufficient to maintain said catch member in said first position thereby allowing said catch member to move into said second position; and wherein, when said catch member is in said second position, the motion of said operating mechanism is arrested.

2. The catch assembly of claim 1 wherein:

when said catch member is in said second position, both said first and second contacts may not be engaging said fixed contact.

3. The catch assembly of claim 1 wherein said operating mechanism includes an L-link, a primary link, and a control device actuator having at least one actuator link, said L-link being rotatably coupled to said housing assembly, said actuator structured to move said at least one actuator link between a first position and a second position, said at least one actuator link coupled to said L-link and structured to rotate said L-link relative to said housing between a first position and a second position, wherein said L-link is in said first position when said at least one actuator link is in said first position, said L-link is in said second position when said at least one actuator link is in said second position, said L-link coupled to said primary link, said primary link structured to be in a first position when said L-link is in said first position, said primary link structured to be in a second position when said L-link is in said second position, said primary link further coupled to said first and second movable contacts, and wherein, when said primary link is in said first position, said first movable contact is in said second position and said second movable contact is in said first position and when said primary link is in said second position, said first movable contact is in said first position and said second movable contact is in said second position, and wherein:

said catch member assembly includes a pivot member;

said catch member assembly pivot member coupled to said L-link; and said catch member rotatable coupled to said pivot member.

4. The catch assembly of claim 3 wherein:

said at least one spring is a torsion spring having a first end and a second end, a first end extension and a second end extension;

said torsion spring disposed about said pivot member;

said torsion spring first end extension engaging said catch member; and said torsion spring second end extension engaging said L-link.

5. The catch assembly of claim 4 wherein said L-link having a body that includes a first end, a vertex, and a second end, said L-link first end, vertex and second end generally defining a plane, said L-link rotatably coupled to said housing at said vertex, said primary link movably coupled to said L-link second end, and wherein said catch member assembly pivot member is coupled to L-link first end.

6. The catch assembly of claim 5 wherein said operating mechanism is structured to return to said stationary condition after cessation of said withstand motion condition and wherein said at least one spring structured to return said catch member to said first position from said second position when said operating mechanism returns to said stationary condition.

7. The catch assembly of claim 1 wherein said operating mechanism is structured to return to said stationary condition after cessation of said withstand motion condition and wherein:

said at least one spring structured to return said catch member to said first position from said second position when said operating mechanism returns to said stationary condition.

8. The catch assembly of claim 7 wherein said catch member has a hook-shaped body.

9. The catch assembly of claim 8 wherein said catch stop is coupled directly to said housing.

10. The catch assembly of claim 9 wherein said housing includes a plurality of generally planar walls and wherein said catch stop is a post extending generally perpendicular to a housing wall.

11. An automatic transfer switch comprising:

a housing assembly having a plurality of walls defining a substantially enclosed space;

a first line movable contact disposed in said enclosed space;

a second line movable contact disposed in said enclosed space;

a fixed contact assembly disposed in said enclosed space;

an operating mechanism disposed in said enclosed space, said operating mechanism having at least one link and structured to move said first line movable contact and said second line movable contact;

said first line movable contact structured to move between a first position, wherein said first line movable contact does not engage said fixed contact assembly, and a second position, wherein said first line movable contact engages, and is in electrical communication with, said fixed contact assembly;

said second line movable contact structured to move between a first position, wherein said second line movable contact does not engage said fixed contact assembly, and a second position, wherein said second line movable contact engages, and is in electrical communication with, said fixed contact assembly;

said operating mechanism further structured to allow only one of said first or second movable contacts to be in said second position at one time;

said operating mechanism further structured to be in one of at least three conditions, a stationary condition, a standard motion condition, or a withstand motion condition, wherein when said operating mechanism is in said stationary condition said operating mechanism and said first and second movable contacts are not moving, wherein when said operating mechanism is in said standard motion condition said operating mechanism is moving said first and second movable contacts to the other position at a standard speed, and wherein when said operating mechanism is in said withstand motion condition said operating mechanism is moving said first and second movable contacts to the other position at a speed faster than said standard speed, a catch assembly including a catch stop, at least one spring having a bias, and a catch member assembly;

said catch member assembly having a catch member;

said catch member movably coupled to at least one said operating mechanism link, said catch member structured to move between a first position, wherein said catch member does not engage said catch stop, and a second position, wherein said catch member engages said catch stop;

said at least one spring structured to engage said catch member and provide a bias thereto;

wherein, when said operating mechanism is in one of said stationary condition or said standard motion condition, said bias applied by said spring to said catch member maintains said catch member in said first position;

wherein, when said operating mechanism is in said withstand motion condition, said bias applied by said spring to said catch member is insufficient to maintain said catch member in said first position thereby allowing said catch member to move into said second position; and wherein, when said catch member is in said second position, the motion of said operating mechanism is arrested.

12. The automatic transfer switch of claim 11 wherein:

when said catch member is in said second position, both said first and second contacts may not be engaging said fixed contact.

13. The automatic transfer switch of claim 11 wherein said operating mechanism includes a L-link, a primary link, and a control device actuator having at least one actuator link, said L-link being rotatably coupled to said housing, said actuator structured to move said at least one actuator link between a first position and a second position, said at least one actuator link coupled to said L-link and structured to rotate said L-link relative to said housing between a first position and a second position, wherein said L-link is in said first position when said at least one actuator link is in said first position, said L-link is in said second position when said at least one actuator link is in said second position, said L-link coupled to said primary link, said primary link structured to be in a first position when said L-link is in said first position, said primary link structured to be in a second position when said L-link is in said second position, said primary link further coupled to said first and second movable contacts, and wherein, when said primary link is in said first position, said first movable contact is in said second position and said second movable contact is in said first position and when said primary link is in said second position, said first movable contact is in said first position and said second movable contact is in said second position, and wherein:

said catch member assembly includes a pivot member;

said catch member assembly pivot member coupled to said L-link; and said catch member rotatable coupled to said pivot member.

14. The automatic transfer switch of claim 13 wherein:

said at least one spring is a torsion spring having a first end and a second end, a first end extension and a second end extension;

said torsion spring disposed about said pivot member;

said torsion spring first end extension engaging said catch member; and said torsion spring second end extension engaging said L-link.

15. The automatic transfer switch of claim 14 wherein said L-link includes a first end, a vertex, and a second end, said L-link first end, vertex and second end generally defining a plane, said L-link rotatably coupled to said housing at said vertex, said primary link movably coupled to said L-link second end, and wherein said catch member assembly pivot member is coupled to L-link first end.

16. The automatic transfer switch of claim 15 wherein said operating mechanism is structured to return to said stationary condition after cessation of said withstand motion condition and wherein:

said at least one spring structured to return said catch member to said first position from said second position when said operating mechanism returns to said stationary condition.

17. The automatic transfer switch of claim 11 wherein said operating mechanism is structured to return to said stationary condition after cessation of said withstand motion condition and wherein:

said at least one spring structured to return said catch member to said first position from said second position when said operating mechanism returns to said stationary condition.

18. The automatic transfer switch of claim 17 wherein said catch member has a hook-shaped body.

19. The automatic transfer switch of claim 18 wherein said catch stop is coupled directly to said housing.

20. The automatic transfer switch of claim 19 wherein said housing includes a plurality of generally planar wall defining an enclosed space and wherein said catch stop is a post extending generally perpendicular to a housing wall.

* * * * *